US005090477A

United States Patent [19]

Sprow et al.

[11] Patent Number: 5,090,477

[45] Date of Patent: Feb. 25, 1992

[54] EVAPORATOR HAVING INTEGRALLY BAFFLED TUBES

[75] Inventors: William Sprow, Clayton; Donald Miller, Adrian, both of Mich.

[73] Assignee: Brazeway, Inc., Adrian, Mich.

[21] Appl. No.: 573,898

[22] Filed: Aug. 28, 1990

Related U.S. Application Data

[63] Continuation-in-part of Ser. No. 255,856, Oct. 11, 1988, abandoned.

[51] Int. Cl.[5] ..... F28D 1/04; B21D 3/14

[52] U.S. Cl. ..... 165/150; 165/176; 29/890.052; 72/367; 228/173.4

[58] Field of Search ..... 165/150, 176; 29/890.052; 228/173.4; 72/367

[56] References Cited

U.S. PATENT DOCUMENTS

| | | | |
|---|---|---|---|
| 1,916,474 | 7/1933 | French et al. | 29/890.035 |
| 2,064,036 | 12/1936 | Sandberg | 165/149 X |
| 2,744,429 | 5/1956 | Seely | 72/367 X |
| 3,557,596 | 1/1971 | Esseluhn et al. | 72/367 |
| 4,162,566 | 7/1979 | Webb | 29/890.035 |
| 4,204,378 | 5/1980 | Thompson | 53/403 |
| 4,825,941 | 5/1989 | Hoshino et al. | 165/110 |

FOREIGN PATENT DOCUMENTS

| | | | |
|---|---|---|---|
| 63-189791 | 8/1988 | Japan | 165/150 |

*Primary Examiner*—Allen J. Flanigan
*Attorney, Agent, or Firm*—Krass & Young

[57] ABSTRACT

A tubular manifold for an evaporator includes an integral baffle formed by deforming a wall section of a header tube onto an opposing wall section and crimping the two side walls inwardly at an axial point where the wall section is deformed. The internal baffle forms a U-shaped seal within the tube and is interposed between two side ports of the manifold.

19 Claims, 2 Drawing Sheets

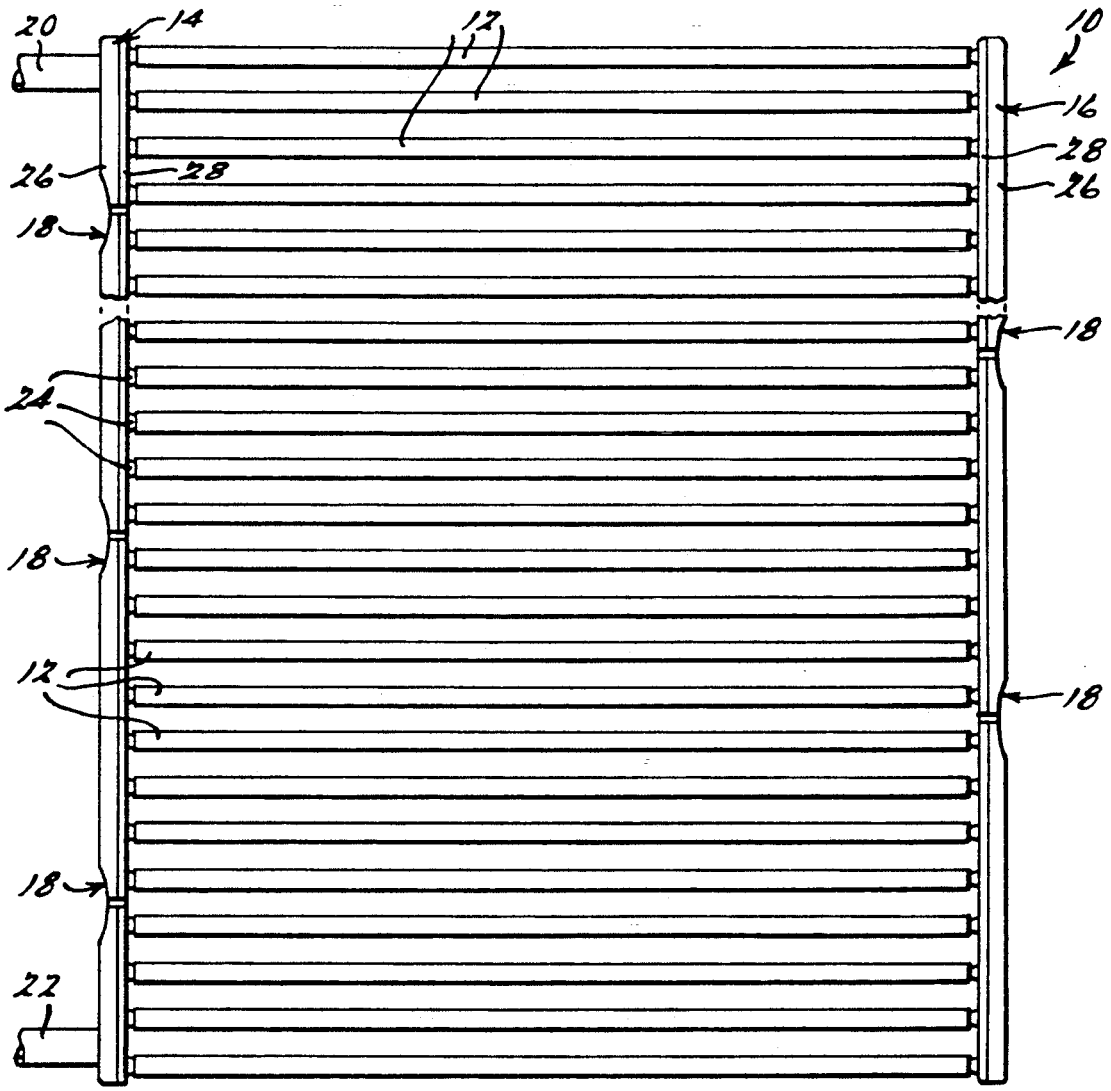
FIG. 1.
FIG. 2.
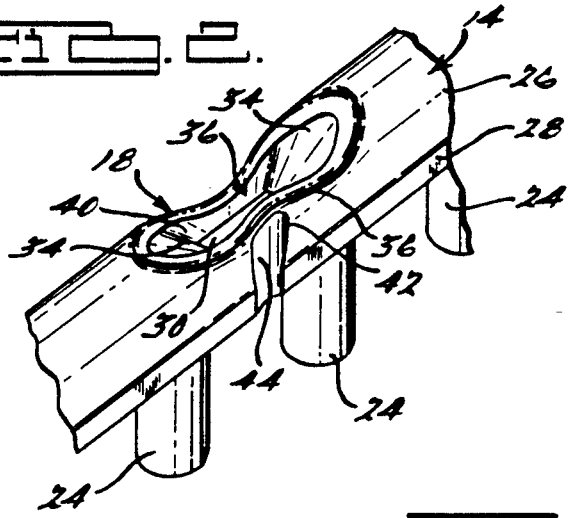
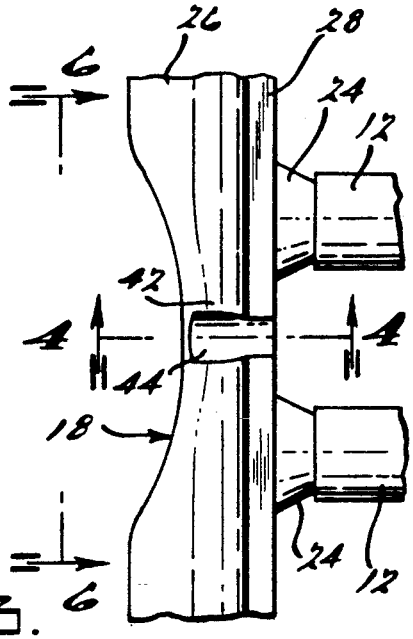
FIG. 3.

EVAPORATOR HAVING INTEGRALLY BAFFLED TUBES

RELATED APPLICATION

This is a continuation-in-part of application Ser. No. 255,856, filed Oct. 11, 1988, now abandoned.

TECHNICAL FIELD

This invention relates to tubing and products fabricated from tubing; in particular, heat exchangers such as evaporators and compressor cores and to a method of forming an internal baffle between the ends of a substantially rigid header tube.

BACKGROUND OF THE INVENTION

Rigid tubing, usually made from aluminum, copper or various ductile alloys, are commonly used in the manufacture of fluid flow systems, for example evaporators and compressor cores for cooling, air conditioning and refrigeration systems. Finned tubing is usually mounted between two rigid end tubes. The two end tubes are baffled so as to direct fluid flow in a particular fashion through the finned tubing. One method of baffling includes inserting a disk inside the tubing from the tube end and then brazing the disk in place. Another method to create a baffle includes cutting the tube on its side and laterally sliding a disk or slug into the tube and brazing the slug or disk to the tube wall.

There are several problems associated with the present methods of forming the internal baffles described above. Firstly, the methods are slow and labor-intensive. The cutting of the tubes and disks, the inserting of the disk in its proper location and the brazing of the disk in place are not steps that are amenable to an automated operation. Secondly, it is difficult to verify the presence and quality of any baffles that lie between two end baffles. Two end baffles can be inspected from open ends of the tube; however, the intermediate baffles are concealed from view and must be tested rather than visually inspected. The exterior tube wall remains smooth and one cannot easily detect a baffle location. Thirdly, the presence of brazing introduces several problems. The brazing material is not integral with the tubing and may chip off or separate from the tubing thereby introducing particulate matter that floats through the system and that can pass and cause damage to fine machine parts of a compressor or pump. Brazing material may also contaminate oil if oil is used as a fluid within the tubing. The brazing material is often corrosive. It can form an acid within a fluid system and degenerate the interior walls of the evaporator and other interior parts of the fluid system. Finally, the brazing material is used not only as a seal but as a mounting device to secure the disc or baffle member in place in the tube.

What is desired is a baffle system which can be easily detected and visually checked from the outside and can withstand pressures that normally occur within compressor cores and under certain applications be brazeless or when used with brazing, the brazing material is used only as a sealant and not as a mount or fastening device.

SUMMARY OF THE INVENTION

According to one aspect of the invention, a method to produce or form internal baffles in a substantially rigid but ductile metal tubing, preferably a manifold for a heat exchanger, includes deformation of a localized portion of the tubing at the desired location of the baffle such that portion of the tube wall is brought into full contact with an opposing portion of the tube wall so as to leave two side portions of the tube wall in an erect condition. Preferably, the side tube walls are also crimped laterally inward to form a self-lock baffle. The resulting deformation of the baffle area is substantially U-shaped in cross section.

Preferably, the deformation step is provided by a punch having a relatively small flat end surface that is used to press the circumferential wall against an opposite circumferential wall of the tube. The thickness of the punch along the transverse direction is less than the outside diameter of the tube and preferably slightly less than the inside diameter of the tube. Two side walls of the punch that are spaced axially along the tube and extend transversely across the tube are flared or canted and also contoured to be convex. Two other side walls of the punch that are spaced transversely and positioned near the sides of the tube have two recessed sections.

In one embodiment, the tubing is placed in a die and the deformation step and crimping step are performed before the tube is removed from the die. Two side punches are incorporated in the crimping step. The side punches are laterally displaced on each side of the tube and are moved to press against the sides of the tube such that the two side punches crimp the tube walls against the center punch in a second operation. Alternately, the crimping step can be performed at a later time on tubing that has been previously deformed.

Another aspect of the invention relates to a heat exchanger having finned cooling tubes connected to two header tubes having a plurality of baffles spaced along the length thereof. Baffles are formed by the one portion of the tube being collapsed against an opposing portion of the tube and then having two side standing and folded portions crimped to form a U-shaped seal in cross section.

Another aspect of the invention relates to a rigid bu ductile tube having side ports and between the two adjacent side ports is positioned at least on baffle formed by deformation and crimping of the tube.

The baffles are self-locking in that any pressure that tends to uplift the deformed wall tends to further crimp the side walls and in which the resistance presented by the side wall crimp is strong enough to prevent the lifting of the top wall. In addition, internal fluid pressure that tends to separate walls of the standing folded portion is also resisted by the existing crimps.

More broadly, the invention relates to forming an internal baffle by permanently collapsing a localized portion of the tube at the desired location such that one circumferential section of the tube is deformed into full contact with an opposing circumferential section and leaving two opposing side walls intact.

It can be foreseen that in certain applications, brazing of the baffle is still desirable. Brazing can easily occur after deformation by dropping in brazing material into the tube against the baffle and heating the tube. The brazing is used only to seal and not as a mount to secure a disc or baffle member to the tube.

In this fashion an evaporator having header tubes is formed where the header tubes have baffles that are able to withstand high pressures normally occurring in compressor systems.

BRIEF DESCRIPTION OF THE DRAWINGS

Reference now is made to the accompanying drawings in which:

FIG. 1 is a front elevational and fragmentary view of a evaporator according to the invention;

FIG. 2 is an enlarged fragmentary and perspective view of a header tube shown in FIG. 1 showing one internal baffle;

FIG. 3 is a fragmentary, side elevational view of the tube shown in FIG. 2;

DETAILED DESCRIPTION OF THE PREFERRED EMBODIMENT

Figure 4:
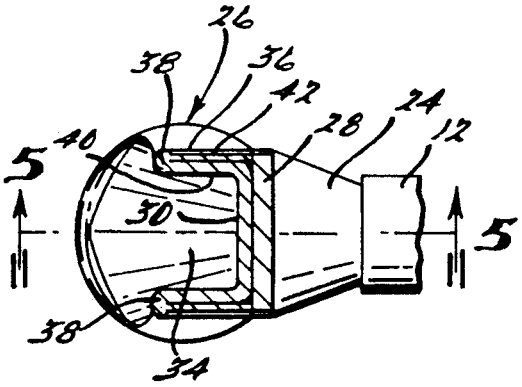
FIG. 4 is a cross-sectional view taken along lines 4—4 shown in FIG. 3.
Figure 5:
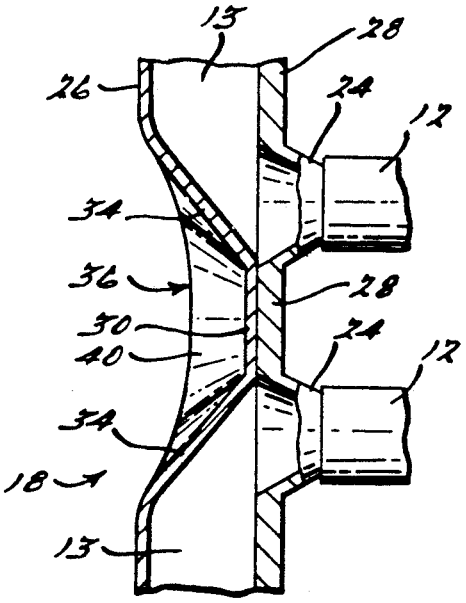
FIG. 5 is a cross-sectional view taken along the lines 5—5 in FIG. 4.
Figure 6:
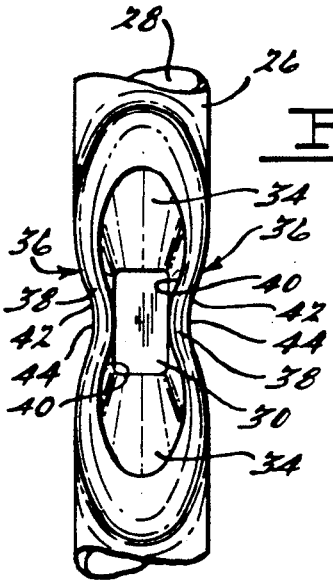
FIG. 6 is a plan view taken along lines 6—6 in FIG. 3.

Referring to FIG. 1, a heat exchanger 10 has a plurality of finned cooling tubes 12 (schematically shown) extending between two headers or manifolds 14 and 16. Each manifold 14 and 16 has a plurality of baffles 18 that direct fluid from inlet 20 to circulate back and forth in the tubes 12 and passages 13 in manifolds 14 and 16 and then exit/outlet 22.

As shown in FIG. 2, manifold 14 has a plurality of ports 24 axially spaced along the length of the manifold 14 and extending from a flat wall 28. Each port 24 is sealingly connectable to a finned tube 12. The baffles 18 are selectively interposed between sequential ports 24.

As shown in FIGS. 2-5, each baffle 18 is formed by the deformation of an initially semicircular wall 26 which, as shown in FIG. 1, is on the lateral outboard side of the heat exchanger 10. The wall 26 is deformed toward the flat wall 28. The wall 26 is deformed to form a flat section 30 that is adjacent and touches the bottom wall 28. On either axial side of flat 30 are sloping and contoured wall portions 34. Spanning the two sloping wall portions 34 are side walls 36. Each side wall 36 is double layered with an interior section 40 an exterior section 42, and an elbow section 38 therebetween. Side wall 36 has a crimped section 44 which is substantially perpendicular with respect to flat 1 30 such that a cross section through section 30 as shown in FIG. 4 shows that the baffle is generally U-shaped. The crimped section 44 provides a self-locking feature. Any pressure normally occurring within manifold 14 which tends to lift the flat section 30 away from wall 228 is resisted by the downward force exerted by the side wall sections 36. The downward force of the side wall sections 36 is provided due to the fact that upward movement of the flat section 30 would further crimp the side section 36.

Any internal pressure exerted to separate wall 42 from wall 40 is resisted. Any further lateral inward motion of wall 40 produces further crimping. Lateral outward motion of wall 42 is resisted due to the over center toggle like action which would occur in wall 42. In this fashion the baffle provides for a complete seal which is resistant against pressurized fluid flow normally found in manifold 14.

Figure 7:
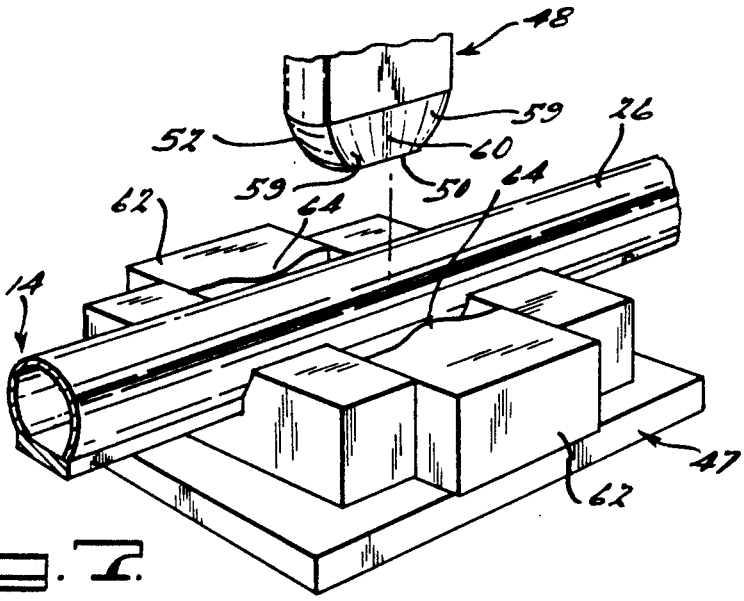
FIG. 7 is a perspective view of the die set including punches forming a baffle in the tube.
Figure 9:
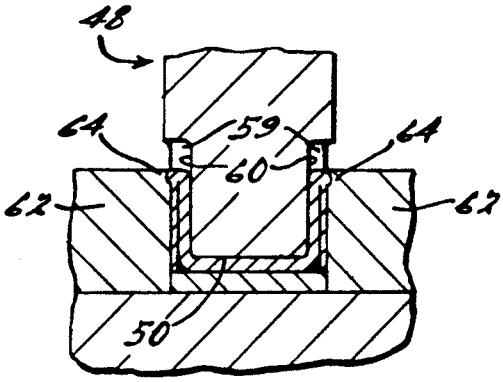
FIG. 9 is a cross-sectional section of the die set forming a baffle.
Figure 8:
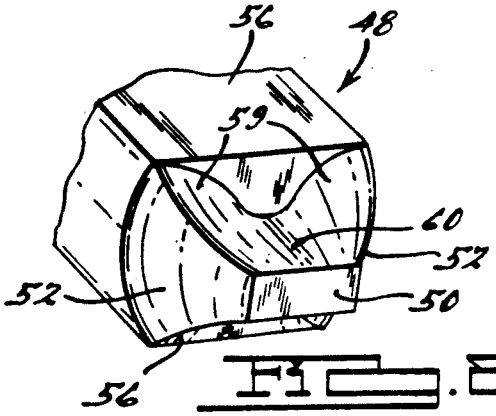
FIG. 8 is a bottom perspective view of the top punch.

Referring now to FIGS. 7-9, the baffle 18 is formed by placing manifold 14 into a die 47 which conforms to the external shape of the manifold 14. A punch 48 is operated to deform wall 26. The punch 48 has a flat bottom section 50 which forms the flat section 30 in the baffle. The punch 48 has two tapered axially spaced convex sections 52 which form sloped contoured walls 34. In addition, span two side sections 56 the convex walls 52 that have flared sections 59 and a recess section 60 centered between flared section 59. The two side punches 62 have centered protrusions 64 and face each other. The punch 48 is driven down and the side punches 62 are driven toward each other such that they hit the side walls 36 and deform the side walls into the flared sections 59 and recess 60 to form the crimped sections 44. The side punches 62 are then withdrawn and the punch 48 is lifted. The manifold 14 is then removed from die 47.

Alternatively, the punch 48 can be lifted after it deforms wall 26. It can then be replaced by a thinner, straight blade and side punches 62 can be laterally moved inward toward the blade. The punch 48 when used in this alternate process can be made without the recesses 60.

The resulting baffle, as shown in FIG. 4, completely seals the passage 13 from an adjacent passage 13 so that there is no leakage between the two adjacent ports 24 that are on either side of the baffle 18. In this fashion a brazeless baffle is integrally created in a manifold between two side ports of the heat exchanger. The baffle provides a complete seal between the two ports on either side of the baffle and is resistant against pressurized fluid flow by having a self-locking feature incorporated within the baffle.

In certain applications it may be desirable to use braze material as a seal at the baffle. The braze material can be inserted in the tube above the baffle 18 and the tube heated such that the braze material coheres to the tube at the formed seams of the baffle. The braze material, however, does not mount one member to another or is used as a fastening device. It functions substantially and only as a seal.

Furthermore, the location of the baffle is visible from the exterior part of the tube and allows for easy detection and location of the baffle.

Variations and modifications of the present invention are possible without departing from its scope and spirit as defined in the appended claims.

The embodiments in which an exclusive property or privilege is claimed are defined as follows:

1. A method of forming an internal baffle between the ends of a substantially rigid tube comprising the step of permanently collapsing the tube at the baffle location such that the tube wall top contacts the tube wall bottom and forms a substantially U-shaped internal seam of double wall thickness; said tube being provided with ports and the baffle being formed between said ports.

2. A method as defined in claim 1 comprising the further step of sealing the seam on at least one side of the baffle.

3. A method as defined in claim 3 wherein the sealing step is carried out by brazing the seam.

4. A method as defined in claim 1 wherein the top wall is collapsed gradually toward the bottom wall and the seam from axially opposite sides thereof.

5. A method as defined in claim 1 wherein the tube material consists at least in part of aluminum.

6. A method as defined in claim 1 wherein the collapsing step is carried out by contacting the top tube wall with a punch.

7. A method of forming an integral baffle between the ends of a substantially rigid tube comprising the step of permanently collapsing the tube at the baffle location such that the tube wall top contacts the tube wall bottom and forms a substantially U-shaped internal seam of double wall thickness wherein the collapsing step is carried out by contacting the top tube wall with a punch and the portion of the punch which contacts the tube is characterized by a small flat end surface and outwardly and upwardly tapering side surfaces which are oriented axially of the tube during the contact, the thickness of the punch transversely of the tube being less than the diameter of the tube.

8. A method of forming an internal baffle between the ends of a substantially rigid metal tube comprising the step of permanently collapsing the tube at the baffle location by bringing the top tube wall into continuous contact with the bottom tube wall to form a continuous seam between the top and bottom tube wall but leaving erect substantial portions of the tube side walls in the baffle location; said erect substantial portions of the tube side walls being shaped and arranged so as to provide a self-locking feature which is effective to prevent said top tube wall that is in continuous contact with the bottom tube wall from being moved away from said bottom tube wall.

9. A method as defined in claim 8 comprising the further step of sealing the seam.

10. A method as defined in claim 9 wherein the sealing step is carried out by brazing the seam.

11. A method of forming an internal baffle between the ends of a substantially rigid metal tube comprising the step of permanently collapsing the tube at the baffle location by bringing the top tube wall into continuous contact with the bottom tube wall to form a continuous seam between the top and bottom tube wall but leaving erect substantial portions of the tube side walls in the baffle location, wherein the collapsing step is carried out by contacting the top tube wall with a punch characterized by a small flat end surface and outwardly and upwardly tapering side surfaces which are oriented axially of the tube during the contact, the thickness of the punch transversely of the tube being less than the diameter of the tube, thereby to leave said erect said wall portions.

12. A tubular manifold having an interior passage circumscribed by a wall, said manifold characterized by:

a first port and a second port axially spaced along the tubular manifold and in fluid communication with the interior of the tubular manifold;

a baffle axially interposed between the first and second ports, said baffle includes;

a circumferential section of said wall of said manifold permanently deformed and depressed against an opposing circumferential wall section; and said circumferential sections of said wall having side portions opposed to each other with said side portions being crimped inwardly.

13. A tubular manifold as defined in claim 12 further characterized by:

said crimped side portions being substantially erect with respect to said circumferential sections; an said crimped side portions having a flared outward section on both axial sides of said abutting section.

14. A tubular manifold as defined in claim 13 further characterized by:

said circumferential section having a substantially flat abutting section and said crimped side portions and said flat abutting section forming a U-shaped baffle.

15. A method of forming an internal baffle between the ends of a ductile rigid tube characterized by the steps of:

deforming a circumferential section of tube wall toward an opposing circumferential section of tube wall till said one section abuts said opposing section; and crimping in side walls of said tube inwardly at an axial position where said circumferential sections abuts.

16. A method as defined in claim 15 further characterized by the steps of:

forming a canted section of tube wall that extends from an undeformed section of tube wall to where said circumferential sections abut; and forming flared outward sections on either side of said crimping side walls.

17. A method as defined in claim 15 wherein:

said deforming is carried out by a first punch; and said crimping is carried out by two opposing side punches positioned transverse to said first punch.

18. A method as defined in claim 15 wherein said deforming and crimping of said tubing is performed while said tubing is positioned in a single die.

19. A heat exchanger having an inlet, outlet, a plurality of heat exchanging tubes and a manifold having an interior passage circumscribed by a wall and having a plurality of axially spaced side ports connected to said heat exchanging tubes for allowing passage of coolant therethrough, the improvement comprising:

said manifold having at least one baffle axially interposed between two of said side ports, said baffle including a circumferential section of said wall being permanently deformed and depressed against an opposing circumferential wall section;

said circumferential sections having side portions opposed to each other with said wall portions being shaped and arranged so as to provide a self-locking feature which is effective to prevent said circumferential deformed section from moving away from said opposing circumferential section.

* * * * *